US006418655B1

(12) United States Patent
Kay

(10) Patent No.: US 6,418,655 B1
(45) Date of Patent: Jul. 16, 2002

(54) UNDERBARREL SHOTGUN

(76) Inventor: Ira M. Kay, 7553 Gary Rd., P.O. Box 1750, Manassas, VA (US) 20109

( * ) Notice: Subject to any disclaimer, the term of this patent is extended or adjusted under 35 U.S.C. 154(b) by 0 days.

(21) Appl. No.: 09/377,068

(22) Filed: Aug. 19, 1999

(51) Int. Cl.[7] ..... F41A 3/72

(52) U.S. Cl. ..... 42/75.02; 42/70.08; 89/185; 89/187.01

(58) Field of Search ..... 42/70.08, 75.02; 89/185, 187.01, 187.02

(56) References Cited

U.S. PATENT DOCUMENTS

| | | | | | |
|---|---|---|---|---|---|
| 922,173 | A | | 5/1909 | Lovelace | |
| 985,309 | A | | 2/1911 | Voorhis | |
| 2,484,988 | A | | 10/1949 | Finlay | 42/79 |
| 2,527,895 | A | | 10/1950 | Tassan | 89/187 |
| 2,676,429 | A | | 4/1954 | Gotterson | 42/79 |
| 2,732,768 | A | | 1/1956 | Browning | 89/182 |
| 3,198,076 | A | * | 8/1965 | Stoner | 42/75.02 |
| 3,199,407 | A | | 8/1965 | Henisa | |
| 3,960,053 | A | * | 6/1976 | Conley | 89/149 |
| 4,358,986 | A | * | 11/1982 | Giorgio | 89/142 |
| 4,677,898 | A | | 7/1987 | Malhotra | 89/187.01 |
| 4,679,486 | A | | 7/1987 | Landaas | 89/126 |
| 4,703,826 | A | * | 11/1987 | Byron | 89/188 |
| 4,867,039 | A | | 9/1989 | Dobbins | 89/127 |
| 4,909,129 | A | | 3/1990 | Reynolds | 89/191.01 |
| 5,198,600 | A | | 3/1993 | E'Nama | 42/90 |
| 5,214,233 | A | * | 5/1993 | Weldle et al. | 89/1.4 |
| 5,448,940 | A | * | 9/1995 | Schuetz et al. | 89/185 |
| 5,673,505 | A | | 10/1997 | Phillips | 42/23 |
| 5,821,445 | A | * | 10/1998 | Guhring | 89/1.42 |
| 5,911,173 | A | * | 6/1999 | Westrom | 89/185 |
| 5,941,005 | A | * | 8/1999 | Battaglia et al. | 42/70.08 |

* cited by examiner

*Primary Examiner*—Stephen M. Johnson
(74) *Attorney, Agent, or Firm*—Shlesinger, Arkwright & Garvey LLP

(57) ABSTRACT

A shotgun comprises a receiver made from a first material; barrel having a portion extending into the receiver and made from a second material; a collar nut securing the barrel to the receiver; a bolt assembly disposed within the receiver and including a locking block configured to project into the barrel portion and lock the bolt assembly to the barrel prior to firing, the bolt assembly including a firing pin; and a trigger mechanism including a hammer for striking the firing pin.

16 Claims, 10 Drawing Sheets

6
132
8
124
58
28
54
106
36
34
60
26
24
28
72
46
74
34
42
48
38
48
40
52
56
36
118
54
50
108

UNDERBARREL SHOTGUN

FIELD OF THE INVENTION

The present invention relates generally to a shotgun and particularly to a lightweight underbarrel shotgun configured to be secured to a main rifle. The present invention also relates to a bolt assembly, a safety mechanism, a trigger mechanism, and a choke and a retractable stand-off device for use in a firearm such as a shotgun.

BACKGROUND OF THE INVENTION

Law enforcement people have found shotguns to be useful for certain applications, such as blasting door locks, windows and even walls to gain entry into a structure in the course of their work. An officer's standard rifle, such as the AR-15 or M-16, could not efficiently do what a shotgun can do. Thus, a dedicated shotgun is typically carried, in addition to the usual rifle, if use of a shotgun is expected in a situation.

There is, therefore, a need to add the capability of a shotgun to an existing rifle to save the officer from carrying two long barrel guns. However, for the shotgun to be useful, it should be lightweight and should weigh less than the combined weight of the two individuals firearms. Additionally, the shotgun should have safety features and ease of use comparable to the standard rifle.

In a single shot firearm, the bolt is typically pulled back to discharge the spent cartridge and load a new cartridge, and pushed back to place the cartridge in the firing chamber and lock the bolt. However, the motions of pulling back and pushing forward are not simple straight line motions. For example, to unlock the bolt, one may have to lift the bolt handle before one can pull it back. In some guns, the motions could be more complicated.

There is, therefore, a need for single shot firearm where a simple straight line motion of pulling or pushing the bolt handle to eject or load a cartridge also unlocks or locks the bolt at the same time.

When a standard shotgun is used to break down a door lock, the end of the barrel is typically placed some distance from the target, to avoid damage to the barrel from flying debris or deflected pellets. If the shotgun is equipped with a stand-off device, the shotgun barrel can rest directly on the target, since the stand-off device will contain any deflected debris or shots. Since not every situation will require a stand-off device, provisions should be provided to allow its quick removal without too much inconvenience.

There is, therefore, a need for a shotgun equipped with a stand-off device that can be easily and quickly deployed or removed as needed.

Since the shotgun is mounted to a main rifle, it is desirable to be able to use the main rifle's sight for shotgun. To do this, the mounting assemblies for the shotgun should have adjustments to orient the shotgun in relation to the sight.

There is, therefore, a need for mounting assemblies used to secure a shotgun to a main rifle to have adjustment capabilities, such as for range adjustment, so the main rifle's sight can also be used for the shotgun.

Safety of use is always a concern to the user. Prior art firearms are equipped with safety devices that are actuated with small levers, which are hard to see. Thus, one has to look hard or feel its position to determine whether the safety device is on or not. It is, therefore, desirable for a firearm to have adequate and dependable safety features that are easy to use and easy to see whether it is ON or OFF.

In severe cold weather conditions, a user could be wearing heavy gloves while being required to operate a firearm. Where the trigger guard is fixed and immovable, the user's gloved index finger may not fit into the space of the trigger. A trigger guard that can swing out of the way to provide additional finger room at the trigger is, therefore, desirable.

Since an auxiliary gun, such as a shotgun, mounted to a main rifle would not be expected to be used most of the time, it should be as unobtrusive as possible to the user whenever it is not being used. The bolt handle is one part of the gun that can get in the way. It is, therefore, desirable that the bolt handle be provided such that it can be moved out of the way when the shotgun is not being used. Further, since the shotgun can be used by either a left or right-handed person, the bolt handle should be ambidextrous.

OBJECTS AND SUMMARY OF THE INVENTION

It is an object of the present invention to provide an underbarrel shotgun for attachment to a main rifle that is relatively lightweight and easy to use.

It is another object of the present invention to provide an underbarrel shotgun with a bolt assembly that uses a simple translatory straight line motion of pulling back or pushing on a handle to unlock or lock the bolt and eject and load a new cartridge into the firing chamber.

It is still another object of the present invention to provide an underbarrel shotgun that includes a safety mechanism that prevents the hammer from being released and the trigger from being actuated.

It is another object of the present invention to provide an underbarrel shotgun with a choke and a retractable stand-off device that positively locks in place either in the retracted or extended position.

It is another object of the present invention to provide an underbarrel shotgun that includes a front mount that allows for range adjustment to permit use of the main rifle's sight.

It is another object of the present invention to provide an underbarrel shotgun that includes a pivotable trigger guard that can be swung out of the way so that a user with bulky gloves can still operate the trigger.

It is also another object of the present invention to provide a shotgun secured to a main rifle whose magazine case functions as handle for the shotgun when in use.

In summary, the present invention provides a gun, comprising a receiver made from a first material; barrel having a portion extending into the receiver and made from a second material; a collar nut securing the barrel to the receiver; a bolt assembly disposed within the receiver and including a locking block configured to project into the barrel portion and lock the bolt assembly to the barrel prior to firing, the bolt assembly including a firing pin; and a trigger mechanism including a hammer for striking the firing pin.

The present invention also provides a bolt assembly for a single shot firearm, comprising a bolt; a bolt carrier slidably connected to the bolt; a firing pin disposed in a longitudinal opening through the bolt and bolt carrier; a locking block configured to lock the bolt assembly preparatory to firing, the bolt including a recess into which the locking block is disposed. The bolt and the locking block include respective slots inclined opposite to one another. The bolt assembly includes a bolt carrier having a vertical slot, and a pin received through the slots thereby to secure the bolt to the bolt carrier. The slots are configured such that translatory movement of the bolt carrier causes the locking block to move vertically within the recess.

The present invention further provides a retractable stand-off device for a shotgun, comprising a tubular member for securing to an end of a barrel, the tubular member including an annular flange having an axial slot; a compressible ring secured against the annular flange; a collar secured to another end of the tubular member and engaging the compressible ring, the collar including an axial slot; and a sleeve disposed around the tubular member in a sliding and concentric manner, the sleeve including a plurality of holes. A rear end of the sleeve includes a pin disposed inwardly and positionable between the annular flange and the compressible ring when the sleeve is extended relative to the tubular member. Similarly, a front end of the sleeve includes a pin disposed inwardly and positionable between the collar and the compressible ring when the sleeve is retracted relative to the tubular member.

The present invention also provides a safety mechanism for a firearm having a trigger for releasing a hammer, comprising a pivotable frame including a member. The frame is positionable from a first position wherein the member is disposed clear of the trigger, to a second position wherein the member is disposed behind the trigger to prevent the trigger from being pulled back.

The present invention further provides a trigger mechanism for a gun, comprising a hammer and a latch configured to hold the hammer in a cocked position; and a trigger operably connected to the latch such that pulling back the trigger is effective to move the latch and release the hammer. The trigger is movable through a first range of motion wherein the hammer is not released and a second range of motion wherein the hammer is released.

The present invention also provides a multiple firearm, comprising a main rifle including a barrel portion and magazine case; and a shotgun secured underneath the barrel portion. The shotgun includes a trigger disposed adjacent the magazine case such that the magazine case functions as a handle when the shotgun is being used.

These and other objects of the present invention will become apparent from the following detailed description.

BRIEF DESCRIPTIONS OF THE DRAWINGS

DETAILED DESCRIPTION OF THE INVENTION

The present invention will be described in the embodiment of a shotgun. However, it should be understood that the invention is also applicable to other types of guns.

Figure 1:
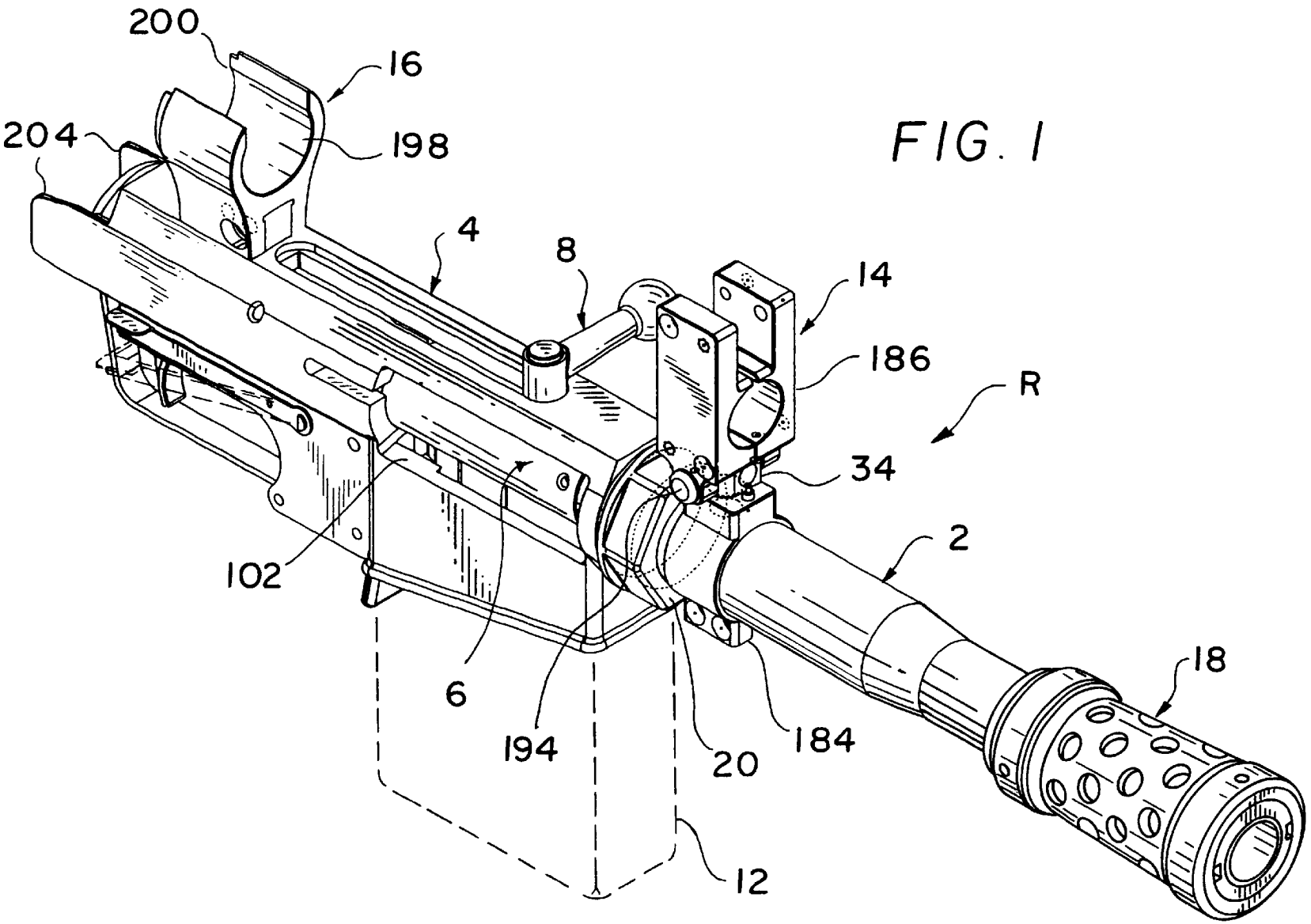
FIG. 1 is a front perspective view of an underbarrel shotgun made in accordance with the present invention.

An underbarrel shotgun R made in accordance with the present invention is disclosed is FIG. 1. The shotgun R comprises a barrel 2, preferably made from steel, joined to a receiver 4, preferably made from aluminum or some other lightweight material. A bolt assembly 6 resides within the receiver 4 and is slidable therewithin pulling back on a handle 8 to retract and eject a spent cartridge 10 (see FIG. 7) and to load a new cartridge from a magazine case 12 into the barrel 2. Front mounting assembly 14 and rear mount 16 are provide to attach the shotgun R to the main rifle. A choke and stand-doff assembly 18 is removably secured to the barrel 2.

Figure 2:
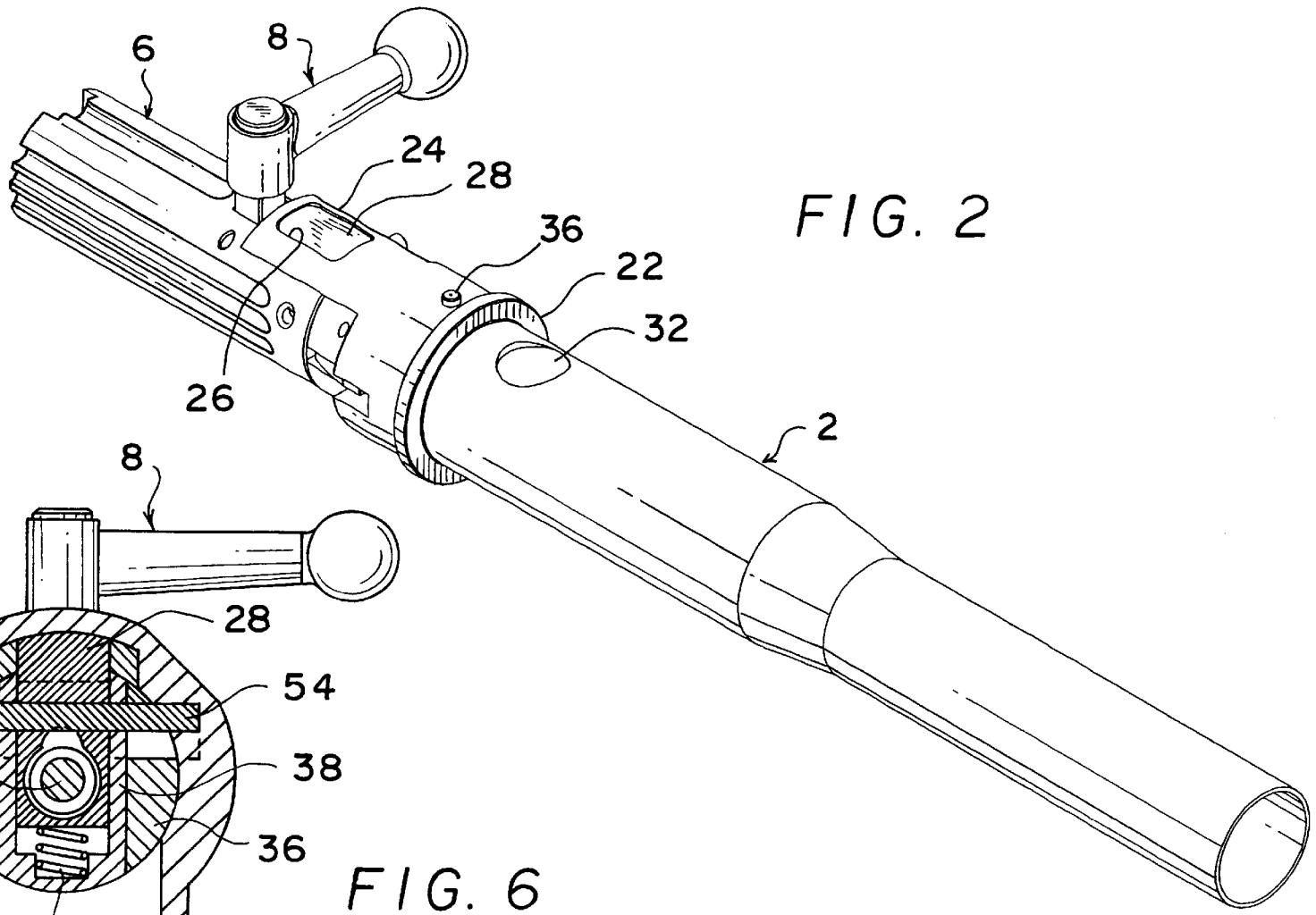
FIG. 2 is a perspective view of a barrel and a bolt assembly made in accordance with the present invention.
Figure 5:
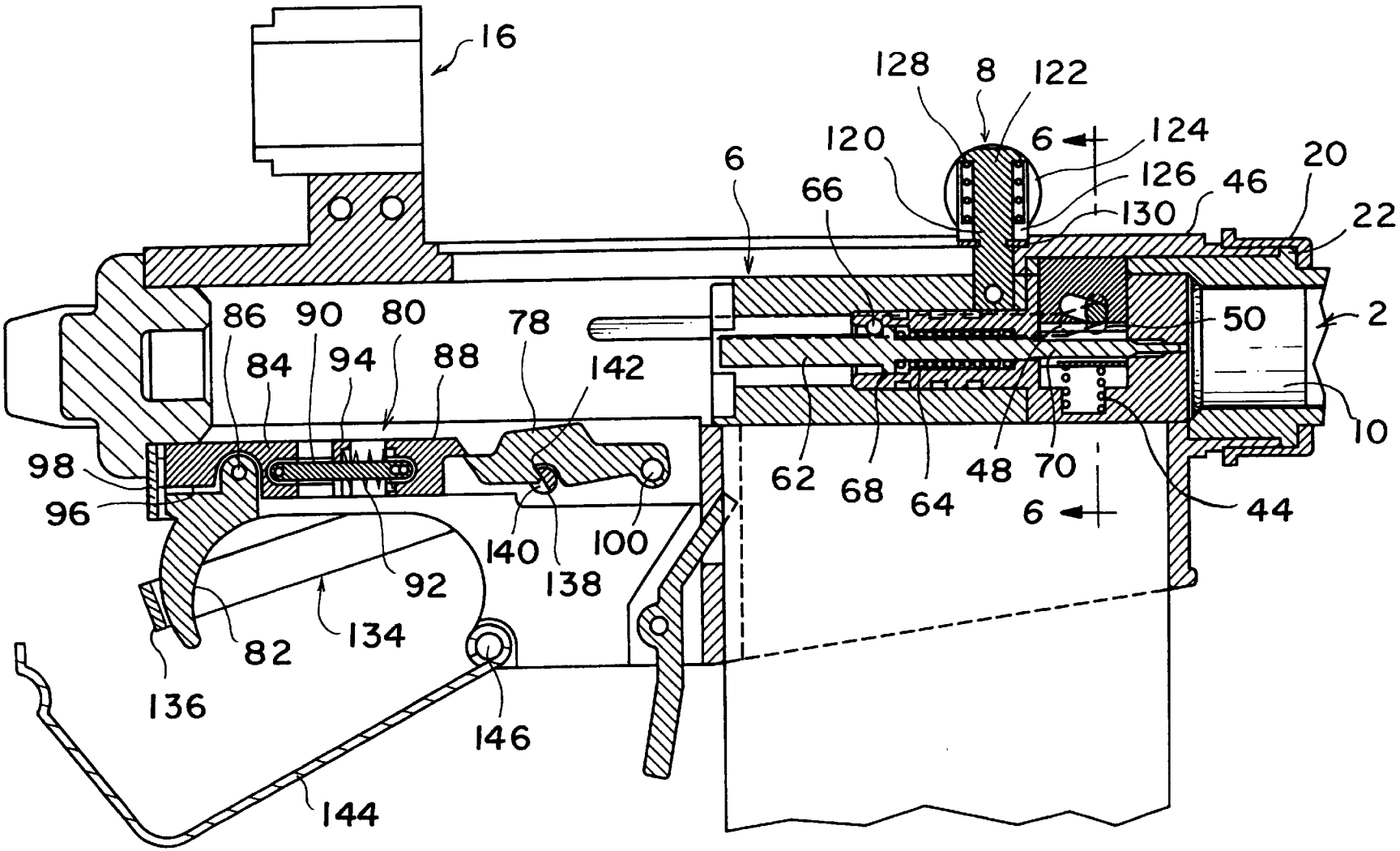
FIG. 5 is a cross-sectional view through the receiver of the underbarrel shotgun shown of FIG. 1, and shows the bolt assembly in the locked firing position, a safety mechanism in the operative ON position and a trigger guard in the open position.

A screw collar 20 secures the barrel 2 to the receiver 4. The screw collar 20 has internal threads that mate with corresponding outside threads on a portion of the receiver 4 such that an annular flange 22 on the barrel 2 is captured within the screw collar 20, as best shown in FIGS. 1, 2 and 5.

The barrel 2 includes a portion 24 that extends into the receiver 4 and includes an opening 26 that receives a locking block 28 that locks the bolt assembly 6 to the barrel 2 prior to firing of the cartridge 10. An indentation 32 provides clearance for the end of threaded member 34 of the front mounting assembly 14 (see FIG. 1). A locating pin 36 is received within a corresponding slot (not shown) in the receiver 4 to aid in lining up the barrel with the receiver during assembly.

Figures 3, 4:
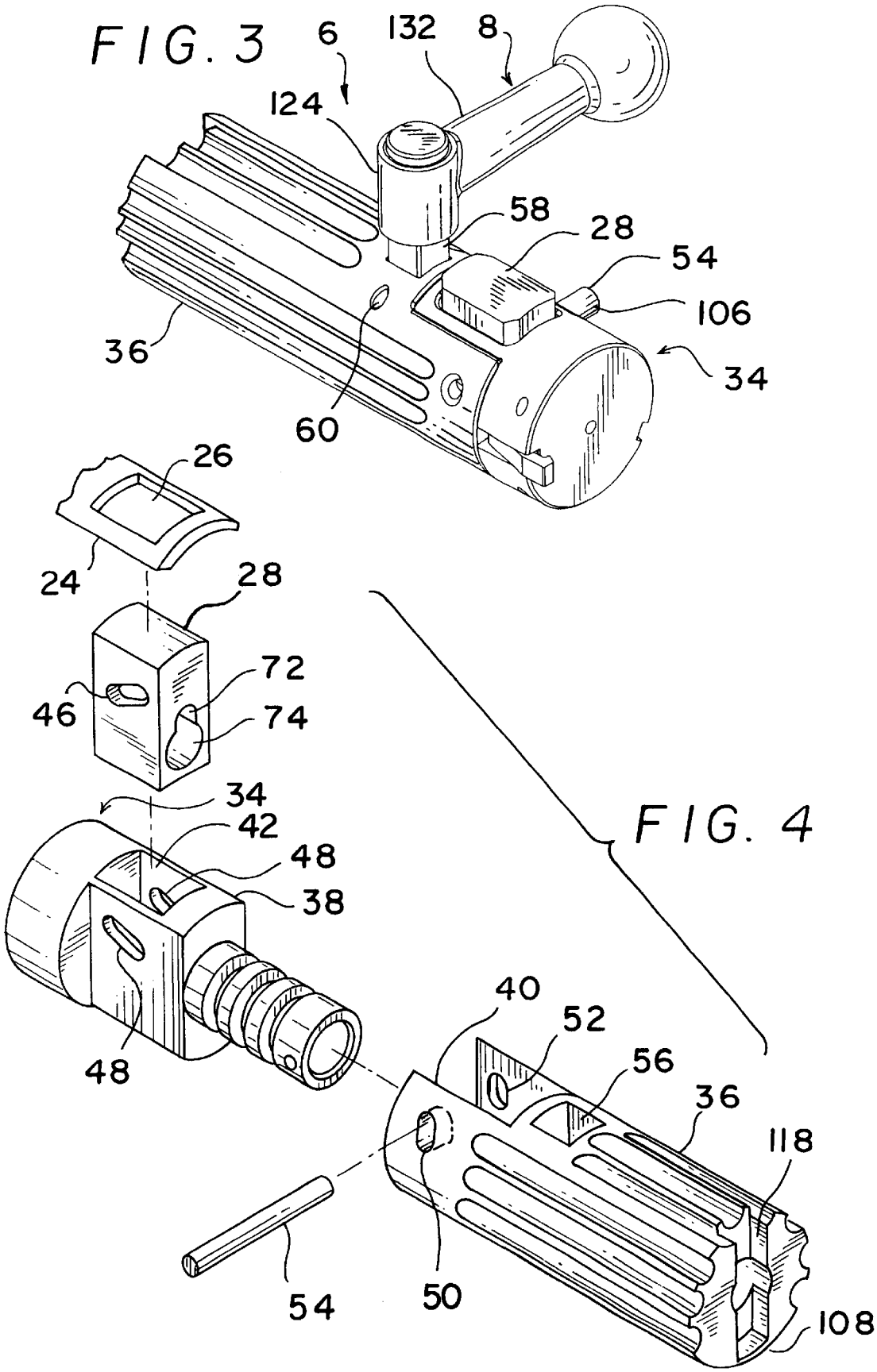
FIG. 3 is a perspective view of the bolt assembly of FIG. 2.
FIG. 4 is an assembly view of the bolt assembly of FIG. 3.

Referring to FIGS. 3 and 4, the bolt assembly 6 includes a bolt 40 operably connected to a bolt carrier 36. The bolt 34 has a flat portion 38 that is received within a corresponding slot 40 in the carrier 36 and slidable therewith. A recess 42 in the bolt 34 slidably receives the locking block 28. A spring 44 disposed at the bottom of the recess 42 urges the locking block 28 upwardly, as best shown in FIG. 5.

Figure 6:
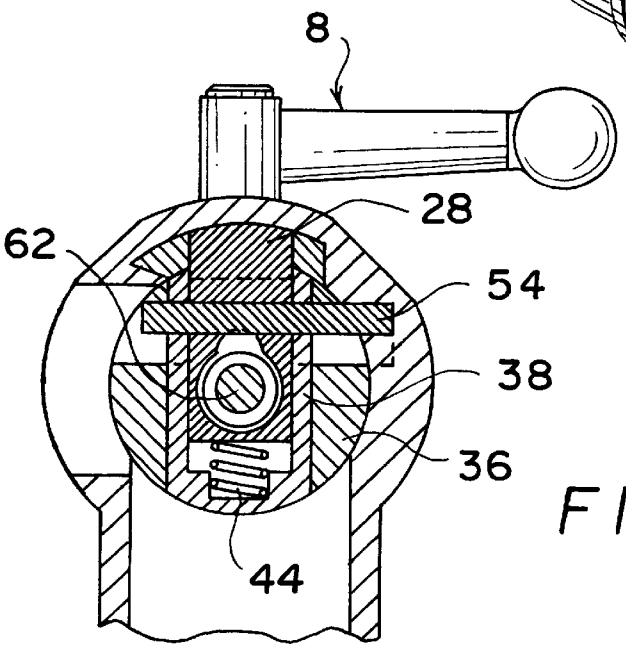
FIG. 6 is a cross-sectional view taken along line 6—6 of FIG. 5.

An elongated inclined slot 46 is disposed through the thickness of the locking block 28. A pair of parallel and aligned elongated slots 48 are disposed in the flat portion 38 and are inclined with a slope opposite to the slope of the slot 46. A vertical elongated slot 50 and a matching vertical elongated recess 52 are disposed at one end of the bolt carrier 36. A pin 54 is received through the slots 46, 48, 50 and the recess 52 to hold the bolt assembly 6 together, as best shown in FIGS. 3 and 6.

A square recess 56 holds a correspondingly square post 58 of the handle 8 and is secured therein with a pin 60.

Figure 7:
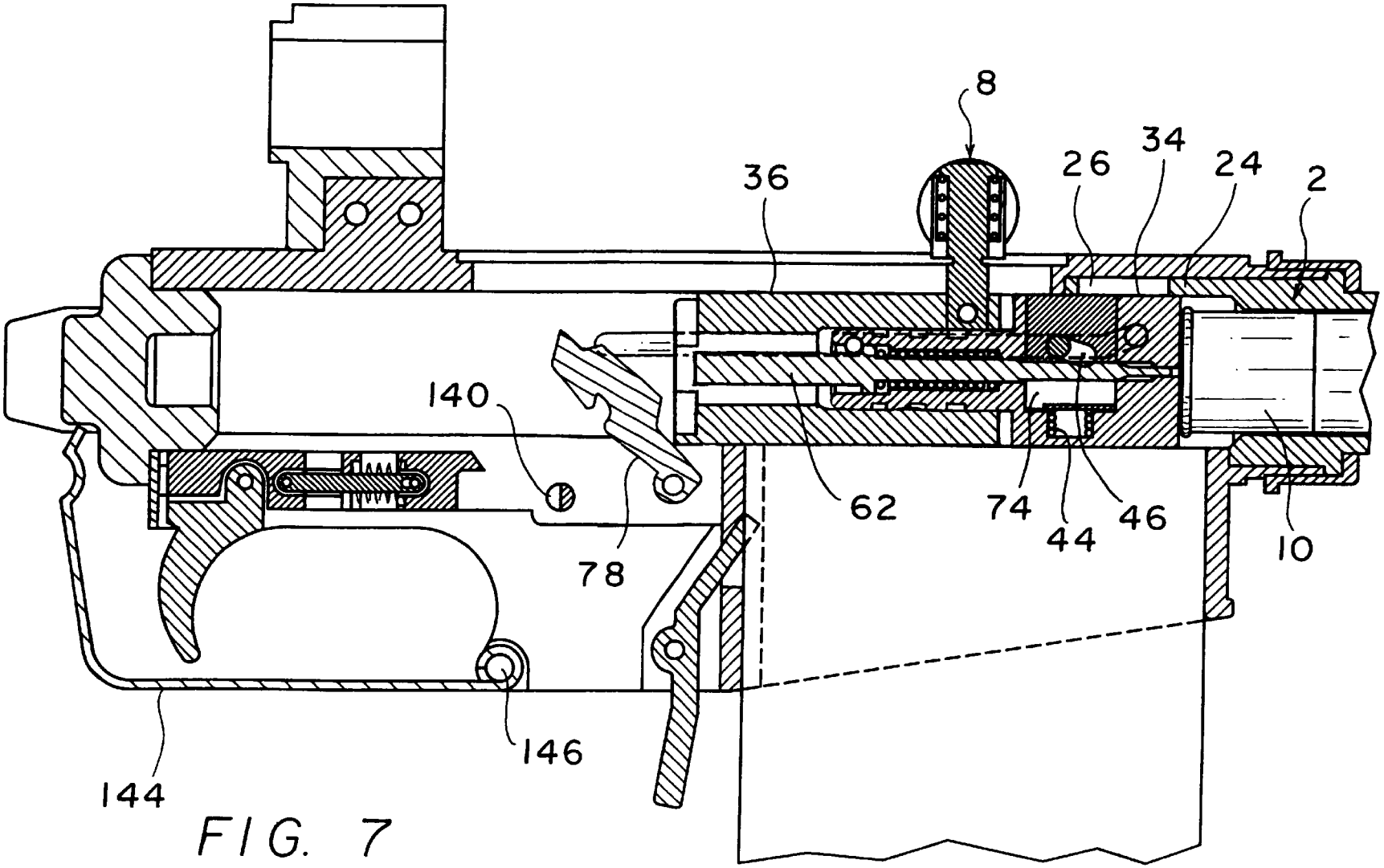
FIG. 7 is a cross-sectional view taken through the receiver of the shotgun, showing the bolt assembly in the process of being pulled back and the locking block completely disengaged from the barrel.

Referring to FIG. 5, the bolt assembly 6 includes a firing pin 62 that is urged by a spring 64 toward the rear of the gun and away from the cartridge 10. A pin 66 engaging an annular flange 68 holds the firing pin 62 against the force of the spring 64. The firing pin 62 has a reduced diameter portion 70 that is receivable within the smaller slot 72 of the keyhole slot 74 in the locking block 28 when the locking block is in the down position, as best shown in FIG. 7. The firing pin 62 has a larger diameter portion 76 that is larger than the smaller slot 72 in the locking block 28 such that the firing pin 62 is prevented from accidentally moving forward and striking the cartridge 10.

Figure 8:
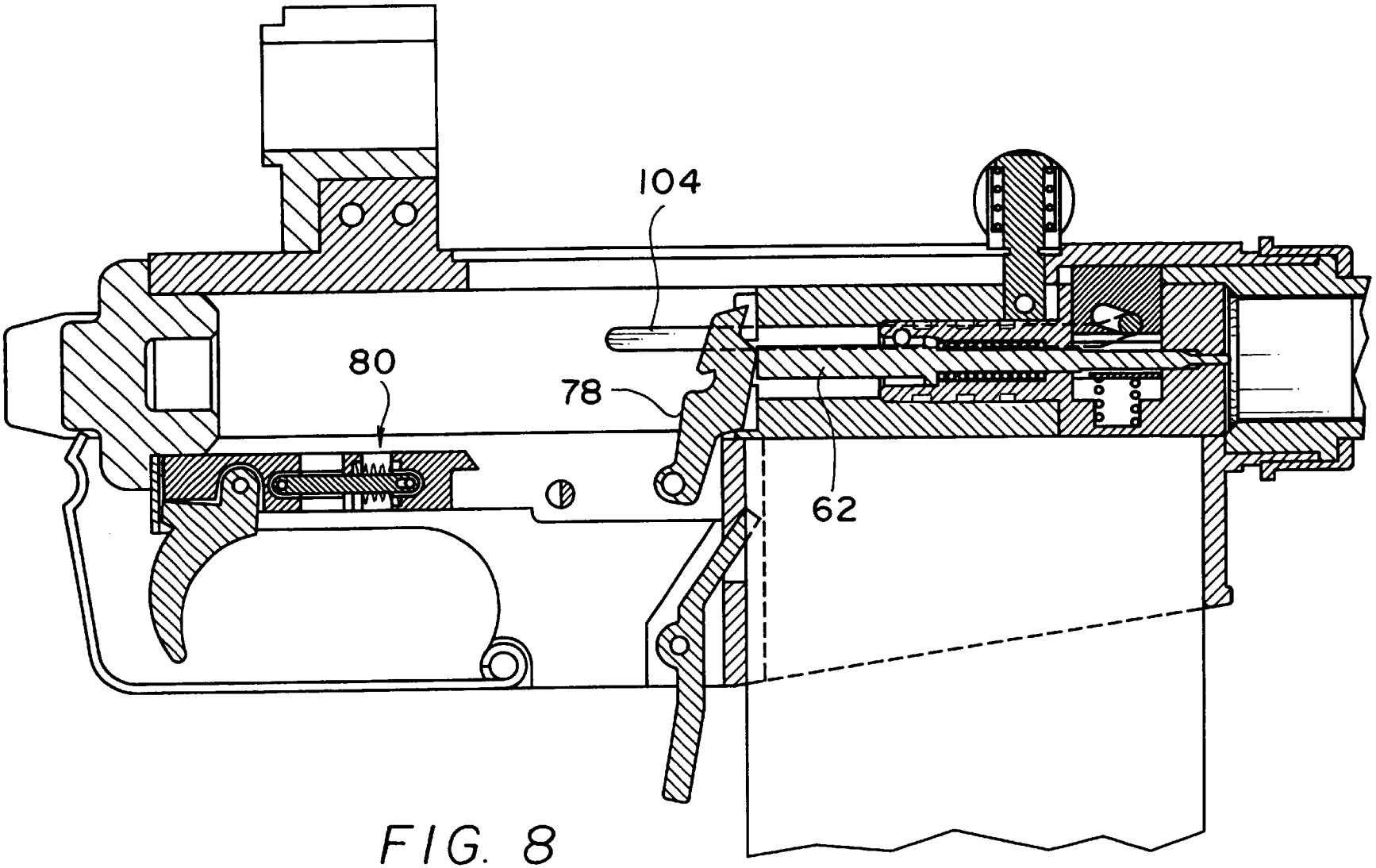
FIG. 8 is a cross-sectional view through the receiver of the shotgun, showing the hammer striking the firing pin.

A hammer 78 is released by a trigger mechanism 80 to hit the rear end of the firing pin 62, thereby discharging the cartridge 10, as best shown in FIGS. 5 and 8. The trigger mechanism includes a trigger 82 connected to a slidable member 84 by a pin 86. A latch member 88 is connected to the slidable member 84 by means of a longitudinal member 90. A spring 92 is disposed between a stationary stop 94 and the latch member 88 to urge the latch member 88 toward the hammer 78. A gap 96 allows the trigger 92 to be pivoted about the pin 86 without releasing the hammer 78, thereby to provide some slack in the trigger mechanism. The play in the trigger movement provided by the gap 96 advantageously provides the user with greater sense of control when pulling the trigger. Further pressure on the trigger 82 causes the member 88 to move back in a sliding manner through a gap 98, pulling the latch member 88 with it to release the hammer 78. The hammer 78 is spring loaded to cause it to rotate about a pin 100 with sufficient force to strike the firing pin 62 and cause the cartridge 10 to discharge, as best shown in FIG. 8.

When the trigger 82 is released, the spring 92 moves the latch member 88 forwardly, ready to accept the hammer 78. A spring (not shown) returns the trigger to its original position about the pin 86. After firing, the bolt assembly 6 is pulled back by means of the handle 8 to eject the spent cartridge through a side opening 102 in the receiver 4, as best shown in FIG. 1.

As the handle 8 is pulled back, the bolt carrier 36 moves away from the bolt 34. The pin 54 will travel from the front to rear of the slots 46 and 48 and from the top to the bottom of the vertical slots 50 and the recess 52. As the pin traverses these slots, as the bolt carrier 36 is pulled back, the locking block 28 will recede into the recess 42 and retract from the opening 26 in the barrel 2, thereby releasing the bolt assembly 6 from the barrel 2. A longitudinal groove 104 disposed on an inside surface of the receiver 4 guides an extending end portion 106 of the pin 54 (see FIG. 3), as the bolt assembly 6 is pulled back, as best shown in FIG. 8. A front portion of the groove 104 is inclined and aligned with the slot 48 in the bolt 34. The locking block 28 is advantageously held immobile within the recess 42 to prevent it from scraping the inside surface of the receiver as the bolt assembly 6 is slid back and forth within the receiver 4.

Figure 9:
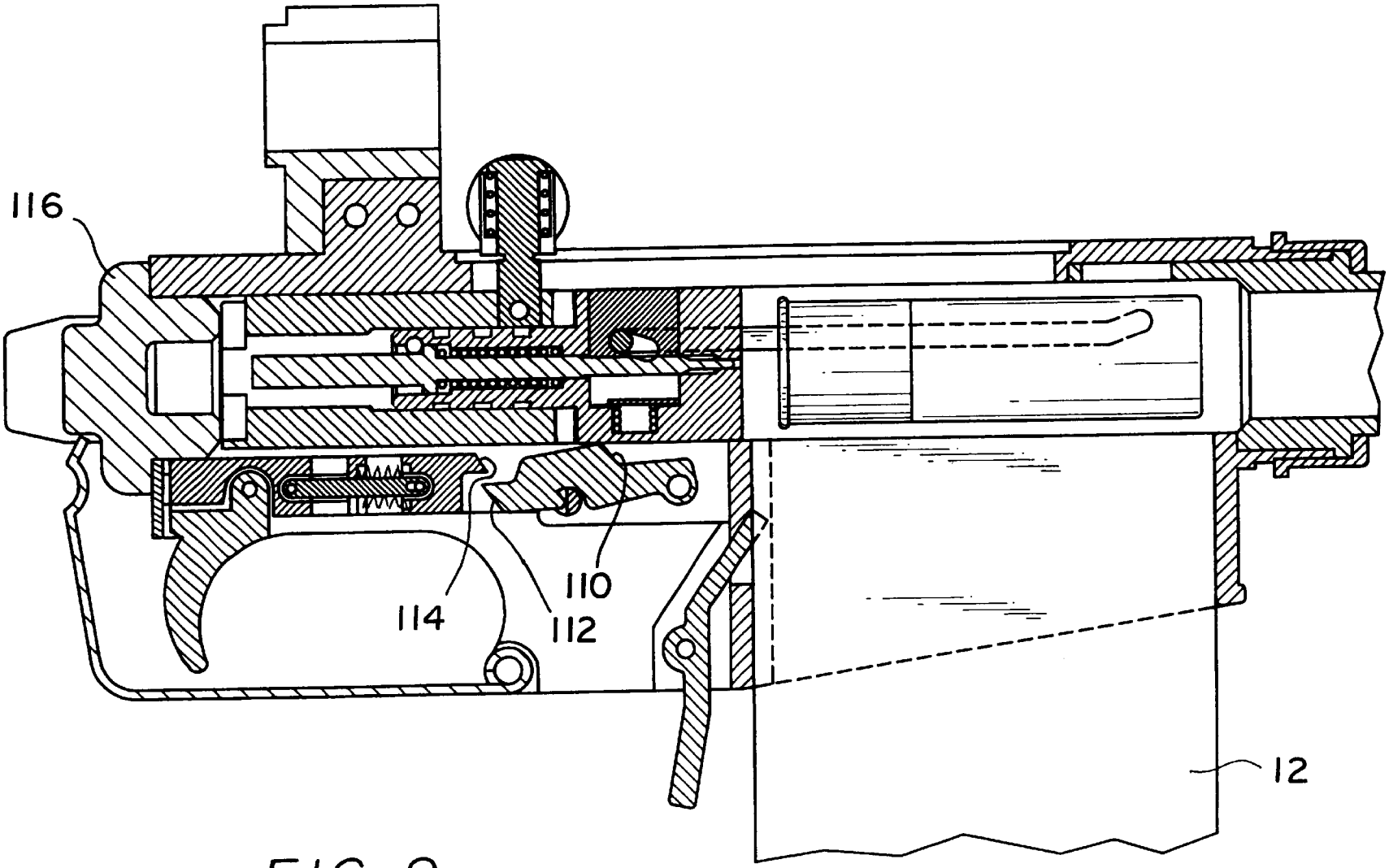
FIG. 9 is a cross-sectional view through the receiver of the shotgun, showing the bolt assembly completely pulled back and a new cartridge being loaded preparatory to being positioned inside the barrel.

As the bolt assembly 6 is pulled back, the shoulder 108 of the bolt carrier 36 pushes the hammer 78 until it is engaged by the latch member 88, as best shown in FIGS. 7 and 9. Sloping surface 110 on the hammer 78 and sloping surface 114 on the latch member 88 advantageously provides a smooth cocking action. A resilient member 116, preferably made of rubber, acts as a bumper stop against the rear end of the bolt assembly 6 as its pulled back.

The end portion of the bolt carrier 36 has a recess 118 to allow the end portion of the firing pin 62 to be recessed in the rear face of the bolt carrier 36, as best shown in FIGS. 5 and 9. The bolt carrier 36 is fluted to reduce weight.

A new cartridge 10 is loaded into the receiver by standard means provided by the standard magazine 12.

Referring to FIGS. 3 and 5, the handle 8 is positionable either to the left or right of the shotgun R, depending on the user's preference, or parallel to the bolt assembly 6 when the shotgun R will not be in use. The post 58 is provided with a portion 120 with a square cross-section and a portion 122 with a circular cross-section. A sleeve 124 includes a portion 126 with a square cross-section that mates with the square portion 120. A spring 128 disposed within the sleeve 124 urges the sleeve 124 against a clip 130. A longitudinal member 132 is attached to the sleeve 124. To change the position of the handle 8, the sleeve 124 is lifted upwardly against the spring 128 until the square portion 130 is positioned in the circular portion 122. The member 132 is then rotated 90° or 180°, depending on the desired position of the handle and the square portion 126 is then allowed to mate with the corresponding square portion 120 of the post 58.

Referring to FIGS. 5 and 7, the shotgun R is provided with a safety mechanism 34 that prevents the hammer 78 from accidentally being released. The safety mechanism 134 includes a U-shape bracket 136 pivotable about a pin 138 with a flat portion 140 that engages a corresponding flat portion 142 in the hammer 78, as best shown in FIG. 5. When the safety mechanism 134 is in the OFF non-safety position, as best shown in FIG. 7, the flat portion 140 is disposed vertically such that it does not project a surface onto the flat portion of the hammer 78. In this position, the hammer is free to rotate about its pin 100. When the bracket 136 is lowered to the ON safety position, as best shown in FIG. 5, the flat portion 140 engages and butts against the flat portion 142, thereby locking the hammer 78 even if the trigger 82 is pulled.

The bracket 36 when in the ON safety position advantageously provides a visual sign that is readily easy to see for the user to determine whether the safety mechanism is ON and provides an obstruction in the area of the trigger 82 to prevent the user from inserting his finger operating into the area to operate the trigger. In addition, the rear end of the bracket 136 prevents backward movement of the trigger 82, as best shown in FIG. 5.

Referring to FIGS. 5 and 7, the shotgun R is provided with a trigger guard 144 pivotable about a pin 146 to allow a user with bulky gloves to still operate the trigger 82.

Figure 10:
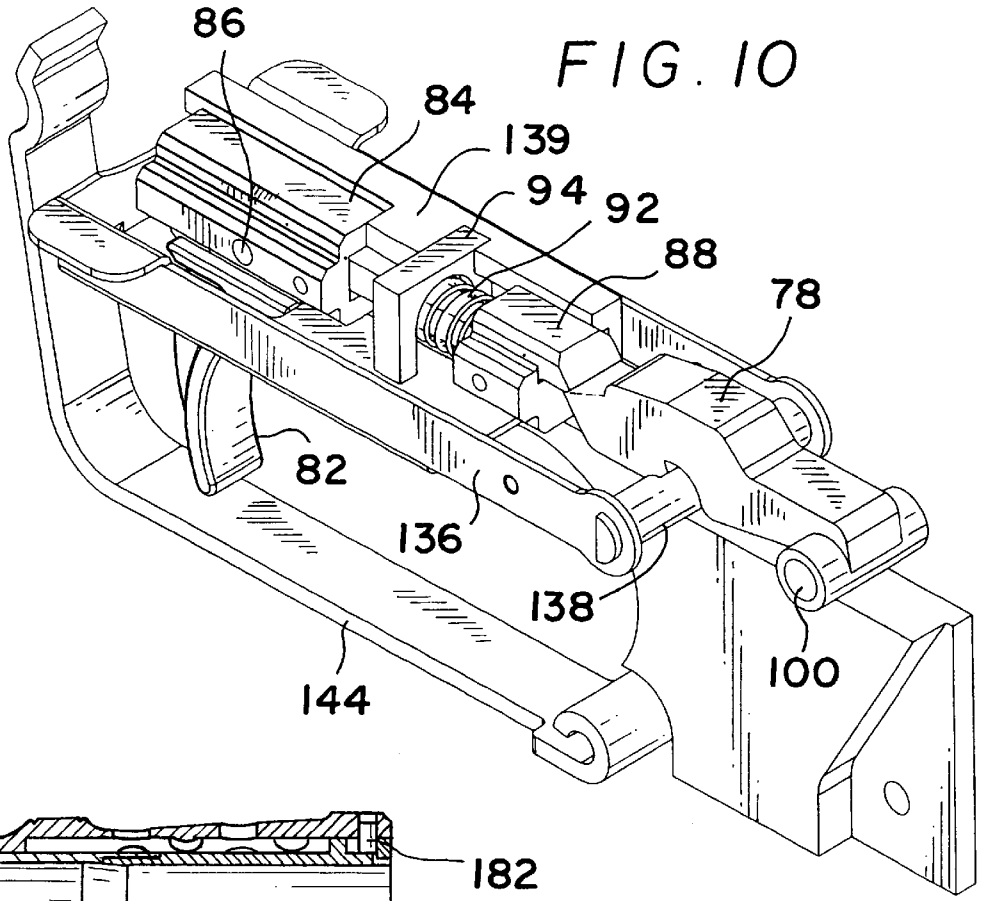
FIG. 10 is a perspective view of the trigger and safety mechanisms made in accordance with the present invention.

Referring to FIG. 10, the members 84, 90 and 88 are disposed in a housing 139 (only one-half shown) that allows them to move only in a sliding translatory manner. Thus, the pivoting motion of the trigger 82 is ineffective in the releasing the hammer 78. At the end of the pivoting motion, as the trigger 82 bottoms out, the member 84 begins to translate as the trigger is further pulled back.

Figure 11:
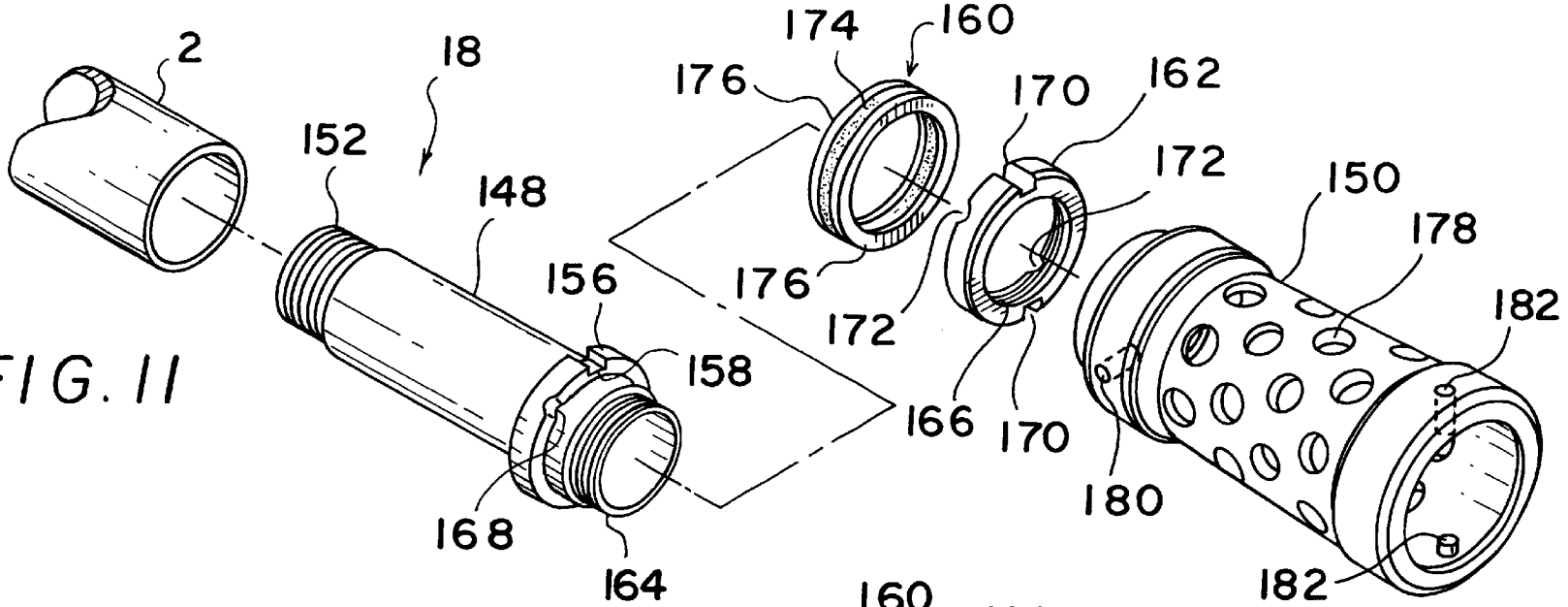
FIG. 11 is an assembly view of a choke and stand-off assembly made in accordance with the present invention.
Figure 12:
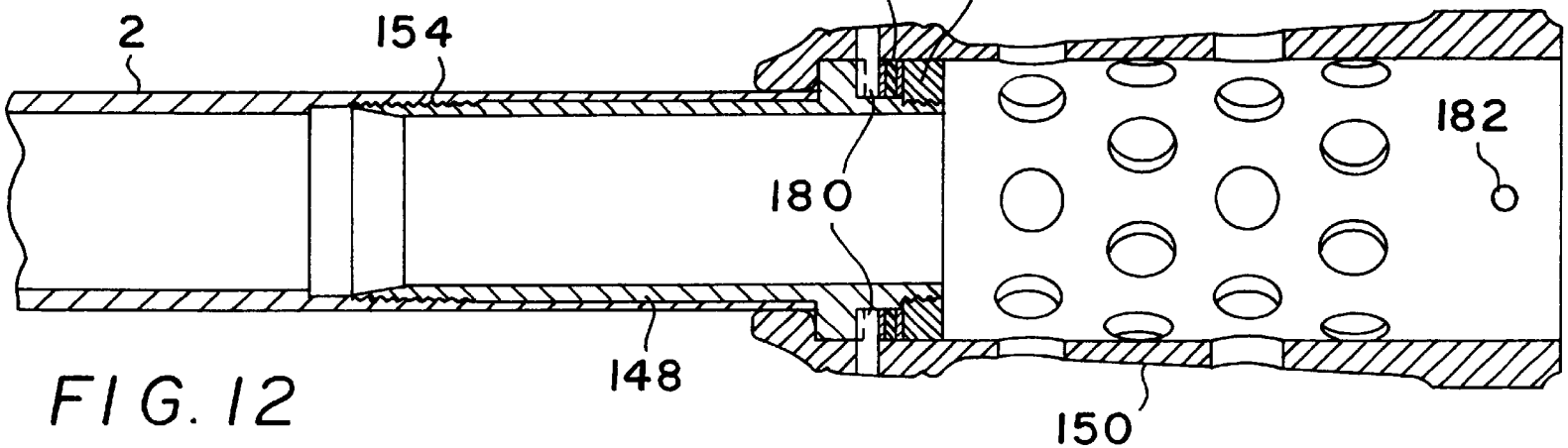
FIG. 12 is a cross-sectional view through the choke and stand-off assembly, showing the stand-off in the extended position.

Referring to FIGS. 11 and 12, the choke and stand-off assembly 18 comprises a choke 148 and a retractable stand-off device 150. The choke 148 is screwed to the end of the barrel 2 by means of outside threads 152 that mate with corresponding inside threads 154 inside the barrel 2. An annular flange 156 with a pair of diametrically opposed slots 58 provides a stop to a composite ring 160 which is secured in place by a collar 162 screwed onto outside threads 164 that cooperate with corresponding inner threads 166 on the collar 162. The annular flange 156 includes a pair of diametrically opposed semicircular recesses 168. The collar 162 includes a pair of diametrically opposed slots 170 and a pair of diametrically opposed half-circular recesses 172.

The ring 160 includes a resilient ring 174, preferably made of rubber, sandwiched between two metal rings 176.

The stand-off device 150 includes a plurality of holes 178 to allow expanding gas to escape when the shotgun is fired with the stand-off device is extended and pressed against the target. A pair of diametrically opposed pins 180 extending inwardly into the stand-off device 150 are used to lock the stand-off 150 in the extended position. A pair of diametrically opposed pins 182 extending inwardly into the stand-off device 150 are use to lock the stand-off 150 in the retracted position.

Referring to FIG. 12, showing the stand-off device 150 in the extended position, the pins 180 are passed from behind the annular flange 156 through the slots 158. The composite ring 162 is compressed and the pins 182 are forced between the annular flange 156 and the composite ring 160 until they rest in the respective recesses 168.

Figure 13:
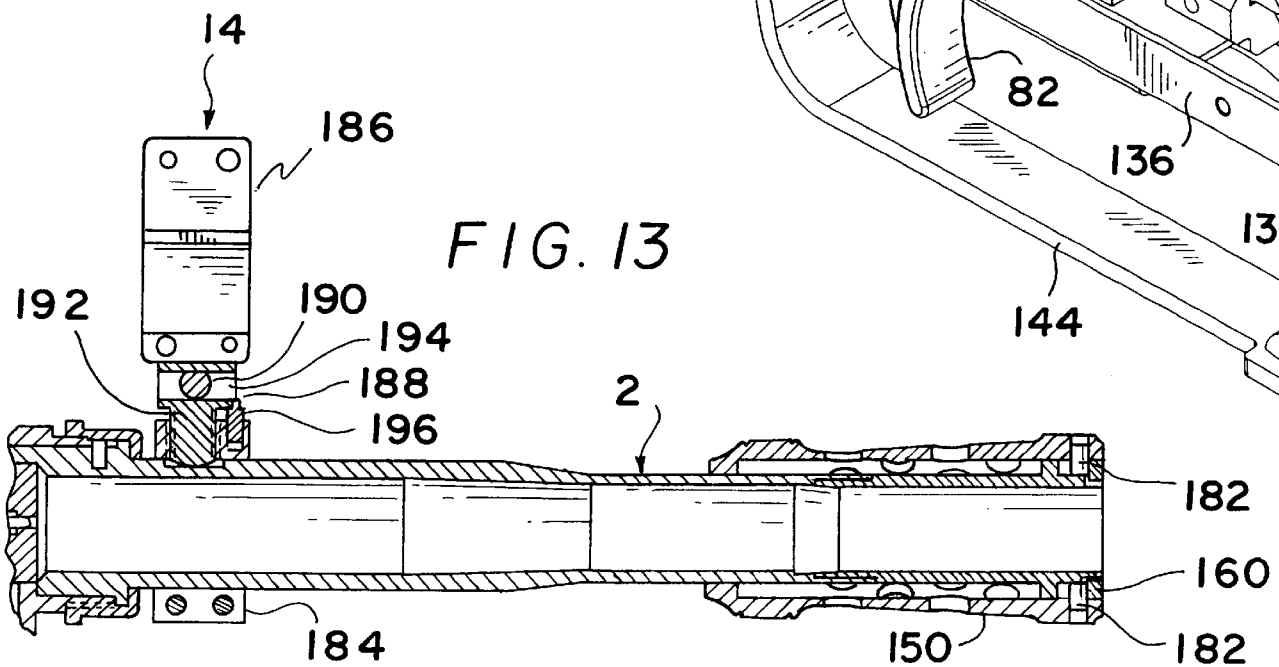
FIG. 13 is a cross-sectional view of the stand-off in the retracted position and the front mounting assembly made in accordance with the present invention.

Referring to FIG. 13, showing the stand-off device 150 in the retracted position, the pins 182 are passed through the slots 170 from the front of the collar 162 and wedged between the collar 162 and the composite ring 160 until they rest in the respective recesses 172.

Referring to FIGS. 1 and 13, the front mount 14 includes a clamp assembly 184 secured around the barrel 2, a clamp assembly 186 for being secured around a frame portion of the main rifle and an intermediate assembly 188 secured to the clamp assembly 186 by a pin 190 and to the clamp assembly 184 by a threaded member 192. The intermediate assembly 188 includes a pair of holes 184, each disposed at right angle to each other. Each of the holes 194 is configured to receive the pin 190. A detent 196 engages a corresponding depression on the intermediate assembly 188 at 90° intervals to provide a positive stop to the intermediate assembly 188 which is turned into or out of the clamp assembly 184 when adjusting for range. The clamp assembly 186 stays secured to the main rifle. To adjust for range, the clamp assembly 184 is disconnected from the clamp assembly 186 by removing the pin 194. The intermediate assembly 188 is then turned one or more quarter turns into or out of the clamp assembly 184 to make the proper range adjustment.

The rear mount 16 is substantially U-shaped with a circular opening 198 adopted to engage a barrel portion of the main rifle. A smaller opening 200 is provided to allow a reduced diameter portion of the main rifle barrel 2 to pass through the mont 16 and be positioned within the larger opening 198 at which time the shotgun is moved into the larger diameter barrel portion of the main rifle where the inner surface of the mount 16 defining the larger opening 198 makes contact with the barrel surface of the main rifle.

Figure 14:
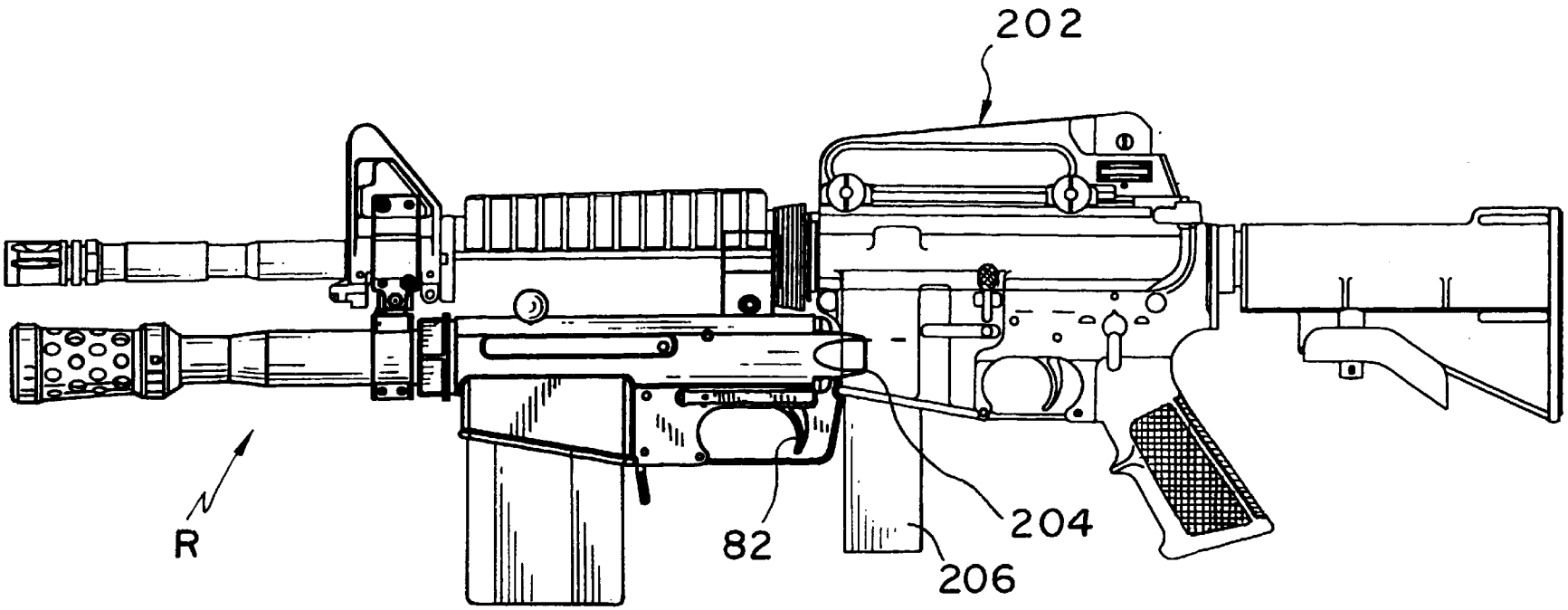
FIG. 14 is a side elevational view of the underbarrel shotgun of FIG. 1, shown secured to a main rifle.

Referring to FIG. 14, the underbarrel shotgun R is shown mounted to a main rifle 202. The receiver 4 has a pair of opposed extending portions 204 configured to receive therebetween a portion of the main rifle to stabilize the shotgun R when mounted to the main rifle. The trigger 82 is advantageously positioned adjacent to a magazine case 206 of the main rifle which acts as a handle for the shotgun R.

While this invention has been described as having preferred design, it is understood that it is capable of further modification, uses and/or adaptations following in general the principle of the invention and including such departures from the present disclosure as come within known or customary practice in the art to which the invention pertains, and as may be applied to the essential features set forth, and fall within the scope of the invention or the limits of the appended claims.

I claim:

1. A gun, comprising:

a) a receiver made from a first material;

b) barrel having a portion extending into said receiver and made from a second material;

c) a collar nut securing said barrel to said receiver;

d) a bolt assembly disposed within said receiver and including a locking block configured to project into said barrel portion and lock said bolt assembly to said barrel prior to firing;

e) said bolt assembly including a firing pin;

f) a trigger mechanism including a hammer for striking said firing pin;

g) said bolt assembly including a bolt having a recess into which said locking block is disposed;

h) said bolt and said locking block including respective slots inclined opposite to one another;

i) said bolt assembly including a bolt carrier having a vertical slot;

j) said bolt assembly including a pin received through said slots thereby to secure said bolt to said bolt carrier; and k) said slots are configured such that translatory movement of said bolt carrier causes said locking block to move vertically within said recess.

2. A gun, comprising:

a) a receiver made from a first material;

b) barrel having a portion extending into said receiver and made from a second material;

c) a collar nut securing said barrel to said receiver;

d) a bolt assembly disposed within said receiver and including a locking block configured to project into said barrel portion and lock said bolt assembly to said barrel prior to firing;

e) said bolt assembly including a firing pin;

f) a trigger mechanism including a hammer for striking said firing pin;

g) said bolt assembly including a bolt having a recess into which said locking block is disposed;

h) said locking block includes a keyhole opening;

i) said bolt assembly including a firing pin having a smaller diameter portion and a larger diameter portion, said smaller diameter portion is next to and forwardly of said larger diameter portion, said firing pin being received within a longitudinal opening of said bolt and said bolt carrier and through said keyhole opening;

j) said keyhole opening including a smaller diameter opening configured to receive said smaller diameter portion and a larger diameter opening configured to allow said larger diameter portion to pass through; and k) said keyhole opening is so disposed such that when said locking block is in a retracted position within said recess, said smaller diameter portion is disposed within said smaller diameter opening of said keyhole opening, thereby preventing forwardly movement of said firing pin.

3. A gun, comprising:

a) a receiver made from a first material;

b) barrel having a portion extending into said receiver and made from a second material;

c) a collar nut securing said barrel to said receiver;

d) a bolt assembly disposed within said receiver and including a locking block configured to project into said barrel portion and lock said bolt assembly to said barrel prior to firing;

e) said bolt assembly including a firing pin;

f) a trigger mechanism including a hammer for striking said firing pin;

g) said bolt assembly including a handle; and h) said handle is positionable transversely to one side or another side of said receiver.

4. A gun as in claim 3, wherein:

a) said first material is aluminum.

5. A gun as in claim 3, wherein:

b) said second material is steel.

6. A gun as in claim 3, wherein:

a) said firing pin includes end portions recessed within said bolt assembly.

7. A gun as in claim 3, wherein:

a) said hammer is pivotable from a cocked position about a pivot to a firing position; and b) said bolt assembly is adapted to engage and move said hammer to said cocked position as said bolt assembly is pulled back.

8. A gun as in claim 7, wherein:

a) said cocked position is substantially horizontal; and b) said firing position is substantially vertical.

9. A gun as in claim 3, wherein:

a) said trigger mechanism includes a trigger pivotable about a pivot carried by a body movable horizontally; and b) said hammer is released when said trigger is pivoted and said body is moved horizontally.

10. A gun as in claim 3, wherein:

a) said handle is positionable parallel to said barrel.

11. A bolt assembly for a single shot firearm, comprising:

a) a bolt;

b) a bolt carrier sidably connected to said bolt;

c) a firing pin disposed in a longitudinal opening through said bolt and bolt carrier;

d) a locking block configured to lock said bolt assembly preparatory to firing;

e) said bolt includes a recess into which said locking block is disposed;

f) said bolt and said locking block includes respective slots inclined opposite to one another;

g) said bolt assembly includes a bolt carrier having a vertical slot;

h) said bolt assembly includes a pin received through said slots thereby to secure said bolt to said bolt carrier; and i) said slots are configured such that translatory movement of said bolt carrier causes said locking block to move vertically within said recess.

12. A bolt assembly as in claim 11, wherein:

a) said locking block includes a keyhole opening;

b) said bolt assembly includes a firing pin having a smaller diameter portion and a larger diameter portion, said smaller diameter portion is next to and forwardly of said larger diameter portion, said firing pin being received within a longitudinal opening of said bolt and said bolt carrier and through said key hole opening;

c) said keyhole opening includes a smaller diameter opening configured to receive said smaller diameter portion and a larger diameter opening configured to allow said larger diameter portion to pass through; and d) said keyhole opening is so disposed such that when said locking block is in a retracted position within said recess, said smaller diameter portion is disposed within said smaller diameter opening of said key hole opening, thereby preventing forwardly movement of said firing pin.

13. A gun, comprising:

a) a barrel and a receiver operably secured to said barrel;

b) a bolt assembly disposed within said receiver;

c) said bolt assembly including a firing pin;

d) a trigger mechanism including a hammer for striking said firing pin;

e) said bolt assembly including a bolt having a recess into which said locking block is disposed;

f) said bolt and said locking block including respective slots inclined opposite to one another;

g) said bolt assembly including a bolt carrier having a vertical slot;

h) said bolt assembly including a pin received through said slots thereby to secure said bolt to said bolt carrier; and i) said slots are configured such that translatory movement of said bolt carrier causes said locking block to move into or out of said recess.

14. A gun, comprising:

a) a barrel and a receiver operably secured to said barrel;

b) a bolt assembly disposed within said receiver;

c) said bolt assembly including a recess into which said locking block is disposed;

d) said bolt assembly including a firing pin;

e) a trigger mechanism including a hammer for striking said firing pin;

f) said bolt assembly including a bolt having a recess into which said locking block is disposed;

g) said locking block including a keyhole opening;

h) said bolt assembly including a firing pin having a smaller diameter portion and a larger diameter portion, said smaller diameter portion is next to and forwardly of said larger diameter portion, said firing pin being received within a longitudinal opening of said bolt and said bolt carrier and through said keyhole opening;

i) said keyhole opening including a smaller diameter opening configured to receive said smaller diameter portion and a larger diameter opening configured to allow said larger diameter portion to pass through; and j) said keyhole opening is so disposed such that when said locking block is in a retracted position within said recess, said smaller diameter portion is disposed within said smaller diameter opening of said keyhole opening, thereby preventing forwardly movement of said firing pin.

15. A bolt assembly for a single shot firearm, comprising:

a) a bolt;

b) a firing pin disposed in a longitudinal opening through said bolt;

c) a locking block configured to lock said bolt assembly preparatory to firing;

d) said bolt including a recess into which said locking block is disposed;

e) said locking block including a keyhole opening;

f) said bolt assembly including a firing pin having a smaller diameter portion and a larger diameter portion, said smaller diameter portion is next to and forwardly of said larger diameter portion, said firing pin being received within a longitudinal opening of said bolt and through said key hole opening;

g) said keyhole opening including a smaller diameter opening configured to receive said smaller diameter portion and a larger diameter opening configured to allow said larger diameter portion to pass through; and h) said keyhole opening is so disposed such that when said locking block is in a retracted position within said recess, said smaller diameter portion is disposed within said smaller diameter opening of said key hole opening, thereby preventing forwardly movement of said firing pin.

16. A bolt assembly for a single shot firearm, comprising:

a) a bolt;

b) a firing pin disposed in a longitudinal opening through said bolt;

c) a locking block configured to lock said bolt assembly preparatory to firing;

d) said bolt assembly including a recess into which said locking block is disposed; and e) means for moving said locking block within said recess into a locked or unlocked position, said means for moving including respective slots in said bolt assembly and said locking block and a pin received within said slots.

* * * * *